United States Patent [19]

Fisher

[11] 4,454,445

[45] Jun. 12, 1984

[54] SPARK PLUG ATTACHMENT

[76] Inventor: Bernard C. Fisher, 41 Brookside Ave., Englewood, N.J. 07631

[21] Appl. No.: 92,225

[22] Filed: Nov. 7, 1979

[51] Int. Cl.[3] ..... F02M 57/06

[52] U.S. Cl. ..... 313/120

[58] Field of Search ..... 313/120

*Primary Examiner*—David K. Moore

[57] ABSTRACT

This invention comprises an attachment for a spark plug which is to be used in place of the usual washer normally inserted between the seat of the plug and the engine block. It comprises a heat conducting sleeve which fits over the threaded end of the plug and extends part way up the body of the plug. The surface of the outer end of the sleeve conforms with the seat in the engine block, so that the sleeve can fit snugly between the engine block and the plug when the plug is screwed into the engine block. The surface of the attachment forming the seat is provided with radial grooves which permit air to pass to the threads during the intake stroke of the engine. This feature, together with the ability to conduct heat rapidly away from the plug, increasing the efficiency of the engine by providing more complete combustion and at the same time decreases the tendancy of the plug to foul and thus increases the life of the plug.

7 Claims, 4 Drawing Figures

SPARK PLUG ATTACHMENT

The efficiency of an internal combustion is reduced when the gas mixture in the cylinder is not completely burned. This leads to formation of carbon within the cylinder and fouling of the spark plug. In my U.S. Pat. No. 2,646,782, I disclose a specially designed spark plug which provides more complete combustion of the gas mixture and thus increases the efficiency of the engine by permitting air to flow at high velocity into the cylinder adjacent the sparking electrodes. The present invention approaches these same results in a simpler form, providing a device which may be used with a standard spark plug.

It is one of the objects of the invention to provide an attachment for a spark plug which will fit over the lower end of the plug and form a seat for the plug in place of the usual washer, the attachment having a high heat conductivity so as to dissipate heat rapidly from the plug, the attachment also having means to permit air to pass into the cylinder during the intake stroke of the engine at extremely high velocity through the helical clearance space between the threads of the plug and those of the engine block, thus increasing the cooling effect of the plug and also providing more complete combustion.

Another object of the invention is to provide an attachment for a spark plug, as defined in the above paragraph, in which the metal of the attachment is plated inside and outside with high heat conducting material and the means to permit air to pass to the threads comprises transverse grooves across the seat of the attachment.

Other objects of the invention will be apparent as the description of the invention proceeds.

The invention is illustrated in the accompanying drawings in which.

Figure 1:
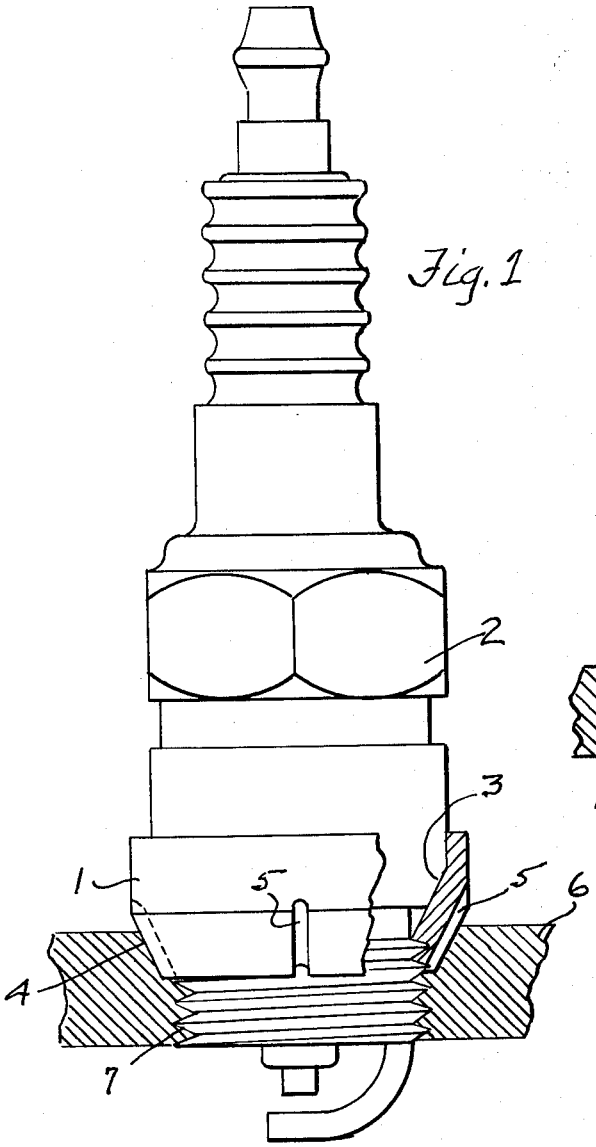
FIG. 1 is a side elevational view of a plug with the attachment of the invention applied thereto, the attachment being partly in section.

Referring now more specifically to the drawings, the attachment comprises a sleeve 1 arranged to fit over the lower end of the standard spark plug 2 having a beveled seat 3. The lower end of the sleeve 1 is thickened and reduced in diameter and has its outer surface 4 beveled to conform to the seat of the engine block 6 in which the plug is to be inserted. The sleeve is preferably made of a hard metal, such as cold rolled steel, and is plated on the outside and inside with a heat conducting meterial, such as copper.

The beveled outer surface 4 of the sleeve 1 is provided with a plurality of radial grooves 5 which lead from the outer surface of the engine block 6 to the threads 7. The inner surface of the lower end of the attachment may be threaded so that the attachment may be screwed onto the plug before the plug is screwed into the engine block.

With the attachment in place on the standard plus and the plug screwed into the engine block, the sleeve takes the place of the usual washer. When the engine is started, air is sucked into the cylinder during the intake stroke through the grooves 5. There is always a slight clearance between the threads of the plug and the threads of the engine block. This provides a helical passage from the atmosphere to the interior of the cylinder through which the air passes at great velocity. Fresh air thus mixes with the gas near the sparking electrodes, flushes out any residual gases from the previous explosion, and provides a richer mixture in preparation for firing. In addition to this action, the high velocity air passing around the threads of the plug help to keep it cool. The volume of cool air is much smaller than that of the hot gases so that the escape of burning gases at the explosion stroke is almost negligible.

The fact that the sleeve 1 is plated with a high heat conductive metal is extremely important. Normally a spark plug attains a very high temperature when the engine is running. The high heat conductivity plating on the sleeve conducts heat very rapidly from the plug to the engine block and thus maintains the plug at a lower temperature. Maintaining the plug at the lower temperature, reduces the formation of carbon and fouling of the plug.

The end result of these effects produced by the attachment of the invention will provide a more complete burning of the gas mixture and will hus increase the efficiency of the engine. At the same time the spark plugs will last much longer.

Figure 3:
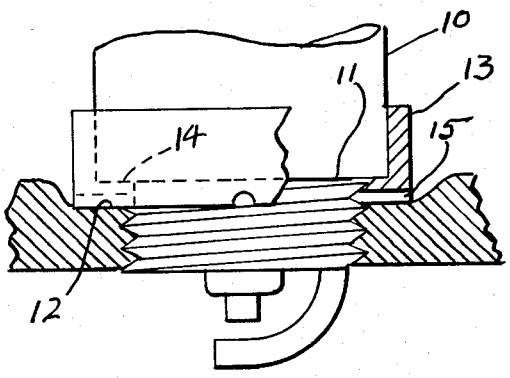
FIG. 3 is a side elevational view of a portion of a spark plug having a seat substantially perpendicular to the axis of the plug with the attachment of the invention designed to fit this particular plug.
Figure 4:
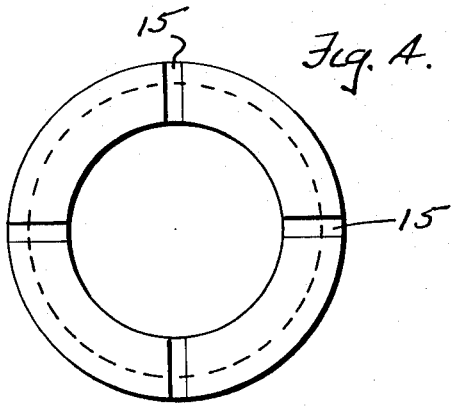
FIG. 4 is a bottom view of the attachment of FIG. 3.
Figure 2:
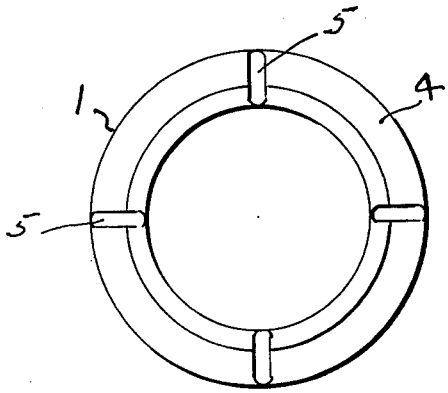
FIG. 2 is a bottom view of the attachment of FIG. 1.

In the arrangement disclosed in FIG. 1, the seat for the plug in the engine block is bevelled and the attachment of the invention is shaped accordingly. In FIG. 3, the spark plug 10 has a seat 11 perpendicular to the axis of the plug and the engine block has a corresponding flat seat 12. The lower end of the sleeve 13 extends inwardly, as at 14, to fit between the two seats. Grooves 15 across the seat of the sleeve 13 have the same effect as the grooves 5 of FIG. 1. Otherwise, the sleeves shown in the two figures operate in the same manner.

While I have shown grooves 5 and 15 in the sleeves of the two respective figures as being four in number, a different number of grooves may be used. Also the size of the grooves may be changed as desired. I have found, however, that four grooves approximately 1/32 inch wide and approximately 1/32 inch deep give good results.

A dynomometer test on a 1977 Buick LaSabre with recommended AC plugs had, without the attachment of the invention, a result of 710 pounds of effort. With the attachment of the invention on the plugs, the same engine showed 730 pounds of effort. Other tests on other cars covering over 1,000 miles of driving showed marked increase in mileage and performance.

While one embodiment of the invention has been shown and described, I do not wish to limit my invention except by the limitations contained in the appended claims.

What I desire to secure and claim by Letters Patent is:

1. An attachment for a spark plug to take the place of the normal washer used in attaching the spark plug to the engine block comprising a sleeve having a higher heat conductivity than that of the body of the plug and having sufficient diameter to slip over the end of the spark plug adjacent the threaded end thereof, the outer end of the sleeve having a surface conforming to the seat of the engine block with which the spark plug is to be used, said seat-conforming surface having a plurality of transverse grooves, whereby, when the spark plug is screwed into the engine block, air passages are provided between the atmosphere and the surface around the threads of said spark plug.

2. An attachment for a spark plug, as defined in claim 1, in which the body of the attachment is made of steel which is copper plated inside and outside.

3. An attachment for a spark plug, as defined in claim 2, in which the metal of the sleeve is approximately 1/16 inch thick.

4. An attachment for a spark plug, as defined in claim 2, in which the end of the attachment adjacent the threaded end of the spark plug is provided with internal threads so that the attachment may be screwed onto the plug before screwing the plug into the engine block.

5. An attachment for a spark plug, as defined in claim 1, in which the end of the attachment adjacent the threaded end of the spark plug is provided with internal threads so that the attachment may be screwed onto the plug before the plug is screwed into the engine block.

6. An attachment for a spark plug, as defined in claim 5, in which the metal of the sleeve is approximately 1/16 inch thick.

7. An attachment for a spark plug, as defined in claim 1, in which the metal of the sleeve is approximately 1/16 inch thick.

* * * * *